US009512673B2

(12) United States Patent
Dibben et al.

(10) Patent No.: US 9,512,673 B2
(45) Date of Patent: Dec. 6, 2016

(54) APPARATUS FOR MOUNTING A SCREEN GUIDE RAIL

(71) Applicant: Ideas By Design Ltd, Hitchin, Hertfordshire (GB)

(72) Inventors: Martin Ross Moulson Dibben, Hertfordshire (GB); John Hammick, Hertfordshire (GB); Paul Neal, Bedfordshire (GB); Marc Jeeves, Bedfordshire (GB)

(73) Assignee: IDEAS BY DESIGN LTD., Hertfordshire (GB)

( * ) Notice: Subject to any disclaimer, the term of this patent is extended or adjusted under 35 U.S.C. 154(b) by 0 days.

(21) Appl. No.: 13/994,516

(22) PCT Filed: Jan. 31, 2013

(86) PCT No.: PCT/GB2013/050216
§ 371 (c)(1),
(2) Date: Jun. 27, 2013

(87) PCT Pub. No.: WO2013/128160
PCT Pub. Date: Sep. 6, 2013

(65) Prior Publication Data

US 2014/0076507 A1 Mar. 20, 2014

(30) Foreign Application Priority Data

Feb. 29, 2012 (GB) ..... 1203480.7

(51) Int. Cl.
*E06B 9/17* (2006.01)
*E06B 9/58* (2006.01)

(52) U.S. Cl.
CPC ..... *E06B 9/58* (2013.01); *E06B 2009/587* (2013.01)

(58) Field of Classification Search
CPC ..... E06B 9/58; E06B 9/581; E06B 2009/587
(Continued)

(56) References Cited

U.S. PATENT DOCUMENTS 4,638,844 A * 1/1987 Hayashiguchi ..... 160/23.1
5,482,104 A * 1/1996 Lichy ..... 160/273.1
(Continued)

FOREIGN PATENT DOCUMENTS

DE 19724433 A1 * 12/1998 ..... E06B 9/58
EP 0775797 A1 * 5/1997 ..... E06B 9/58
(Continued)

OTHER PUBLICATIONS

International Search Report and Written Opinion of PCT/GB2013/050216 mailed on May 24, 2013, 8 pages. UK Search Report of GB1203480.7 mailed Jul. 10, 2012, 3 pages.

*Primary Examiner* — Katherine Mitchell
*Assistant Examiner* — Johnnie A Shablack
(74) *Attorney, Agent, or Firm* — Kilpatrick Townsend & Stockton LLP

(57) ABSTRACT

Apparatus 50 for mounting a rail 52 for guiding one lateral side of a zip-like screen, comprises an elongate body 60, comprising a first elongate part 62 and a second elongate part 64, having a channel 66 for receiving the rail 52. The channel 66 has an open top 68 extending in a first direction 70 along the elongate body (i.e. perpendicular to the page as shown in FIG. 2), and a depth extending in a second direction 72 perpendicular to the first direction 70, from the open top 68 towards the opposing base 74 of the channel 66. The rail 52 is supported in the channel 66 by a support mechanism 80 comprising at least one support member 82 having a plurality of profiles 84A, 84B, 84C, 84D spaced in the second direction 72 when positioned in the channel 66.
(Continued)

Each profile 84A, 84B, 84C, 84D is configured to support the rail 52 at a different depth in the channel 66.

13 Claims, 11 Drawing Sheets

(58) Field of Classification Search
USPC ..... 160/266–273.1, 41, 120, 121.1, 239
See application file for complete search history.

(56) References Cited

U.S. PATENT DOCUMENTS

| | | | | |
|---|---|---|---|---|
| 6,065,525 | A * | 5/2000 | Wells | 160/273.1 |
| 6,138,739 | A * | 10/2000 | Crider et al. | 160/273.1 |
| 6,405,781 | B2 * | 6/2002 | Davies et al. | 160/23.1 |
| 6,412,538 | B1 * | 7/2002 | Welfonder | 160/271 |
| 6,631,749 | B1 * | 10/2003 | Zabala | 160/133 |
| D616,567 | S * | 5/2010 | Desrosiers | D25/122 |
| 7,793,702 | B2 * | 9/2010 | Biewer | B60J 7/0007 160/272 |
| D696,814 | S * | 12/2013 | Matus, Jr. | D26/138 |
| 8,602,081 | B2 * | 12/2013 | Komatsu et al. | 160/273.1 |
| 8,607,841 | B2 * | 12/2013 | Hayashiguchi | E06B 9/581 160/273.1 |
| D699,480 | S * | 2/2014 | Dibben et al. | D6/580 |
| 9,127,501 | B1 * | 9/2015 | Stobich | E06B 9/40 |
| 2003/0155474 | A1 * | 8/2003 | Dean et al. | 248/300 |
| 2006/0144530 | A1 * | 7/2006 | Nagare et al. | 160/271 |
| 2011/0100570 | A1 * | 5/2011 | Licciardi Di Stefano | 160/368.1 |
| 2015/0345215 | A1 * | 12/2015 | Roberts | E06B 9/42 160/368.1 |

FOREIGN PATENT DOCUMENTS

| | | | | |
|---|---|---|---|---|
| EP | 1087094 | A2 | 3/2001 | |
| EP | 1739273 | A | 1/2007 | |
| EP | 1927717 | A1 * | 6/2008 | E06B 9/58 |
| JP | 2004211299 | A | 7/2004 | |
| WO | WO2009/098433 | A1 | 8/2009 | |

* cited by examiner

APPARATUS FOR MOUNTING A SCREEN GUIDE RAIL

TECHNICAL FIELD

The present invention relates to a novel screen system employing a zip-like retention device such as a screen, a method of mounting the same, and particularly but not exclusively apparatus for mounting a rail for guiding one lateral side of a zip-like screen.

BACKGROUND ART

The novel screen system comprises a particular form of roller blind and a pair of guide rails disposed on either side of an aperture to control blind position as it is deployed/retracted to cover/uncover the aperture. The blind fabric has flexible strips on its lateral sides which are trapped within, but free to slide along, a specially shaped groove or keyway in each of the rails. Each flexible strip typically is one half of a zipper, but could be manufactured by moulding a soft or semi-rigid high polymer such as hot-melt synthetic resin or rubber. A roller blind with such flexible strips for engaging corresponding rails is hereinafter referred to as a zip-like screen.

U.S. Pat. No. 4,638,844 discloses an early form of screen system, with a simple bracket for loosely mounting a guide rail. GB 2 235 005 discloses an improved bracket for loosely mounting a guide rail. FIGS. 1A and 1B show existing brackets for loosely mounting a guide rail. The bracket 10 of FIG. 1A is configured to be secured to a surface forming part of the inner periphery of the aperture to be screened, whereas the bracket 20 of FIG. 1B is configured to be secured via an additional flange 22 to a surface extending away from the aperture to be screened. Each bracket 10,20 comprises an aluminium extrusion 30 and a pair of clip-on strips of plastics material 32, which together define a channel 33 for receiving a rail 34 (shown in dotted lines). The rail 34 is supported within the channel 33 by pairs of resilient foam strips 36 which provide some flexibility and allow the depth D of the rail 34 within the channel 33 to vary if required.

A blind system with a zip-like screen is only able to control blind position as it is deployed and retracted if the guide rails are correctly positioned. Even though the rails are loosely mounted in the brackets, a small angular misalignment of the brackets (leading to rails which are not parallel or skewed to one side) can result in blind creasing or jamming. The problem is exacerbated in such blind systems for apertures with a high aspect ratio. A novel bracket for preventing such misalignment was proposed in WO 2009/098433. However, the success of the system relied upon careful installation by an experienced workman, so it did not lend itself to the mass DIY market. Accordingly, the present invention has been devised with a view to addressing or at least ameliorating this problem in a more user friendly way.

STATEMENT OF INVENTION

In accordance with a first aspect of the present invention, there is provided apparatus for mounting a rail for guiding one lateral side of a zip-like screen, comprising: an elongate body having a channel for receiving the rail, the channel having an open top extending in a first direction along the elongate body and a depth extending in a second direction from the open top towards an opposing base of the channel; and a support mechanism, configured to be positioned in the channel, for supporting the rail when received in the channel; characterised in that the support mechanism comprises at least one support member having a plurality of profiles spaced in the second direction when positioned in the channel, with each profile being configured to support the rail at a different depth in the channel.

With such apparatus, the or each support member enables the localised position (i.e. depth) of the rail within the channel to be adjusted during installation in order to achieve correct alignment with the one lateral side of the zip-like screen. For example, the plurality of profiles of the or each support member may be configured to support the rail in one of at least two different depths in the channel, such as three or even four different depths in the channel. Thus, even if the elongate body is slightly out of alignment with the one lateral side of the zip-like screen, the support member(s) may be used to compensate for the misalignment and help ensure the zip-like screen is able to be guided by the rail without creasing or jamming.

The at least one support member may comprise a resilient portion for resiliently supporting the rail when received in the channel. The resilient portion may be configured to allow movement of the plurality of profiles towards the open top of the channel in response to an applied load on the rail tending to pull the rail towards the open top of the channel. The degree of such movement may be less than the span of the plurality of profiles in the second direction. The resilient portion may comprise a spring member.

At least one side wall of the channel may be shaped to retain the at least one support member within the channel in use. For example, the at least one side wall of the channel may include a groove extending therealong for engaging one side of the at least one support member. The at least one side of the at least one support member may be a sliding fit within the groove. In one arrangement, the at least one side of the at least one support member may be resiliently biased within the groove by the resilient portion of the at least one support member.

The elongate body may comprise a first elongate part and a second elongate part which in use is coupled to the first elongate part, with the first elongate part defining a first side wall of the channel and the second elongate part defining a second side wall of the channel. Such an arrangement enables the apparatus to be installed in "layers", starting with the first elongate part, as explained hereinafter. The first and second elongate parts may have interengageable profiles for releasably coupling the second elongate part to the first elongate part. The first elongate part may comprise a first wall inclined relative to a second wall, with each of the first and second walls being configured to receive a fixture therethrough for securing the first elongate part to a support surface. The first wall may be inclined at about 90° to the second wall. In this way, the first elongate part may be fitted to a support surface either forming part of the inner periphery of the aperture to be screened (e.g. a window reveal) or extending laterally away therefrom simply by using fixing means extending through the first or second walls. The first elongate part may have a substantially "L"-shaped cross-section, allowing unhindered access to each of the first and second walls. The second elongate part need only be coupled to the first elongate part once the latter has been secured in place and the support mechanism and rail have been put into position relative to the first elongate part.

The support mechanism may comprise a pair of support members, each having a plurality of profiles spaced in the second direction when positioned in the channel and configured to support the rail at a different depth within the channel, the pair of support members being spaced apart in the first direction. With such an arrangement, the rail may be supported at a first depth in the channel by one of the pair of support members, and at a second depth in the channel by another of the pair of support members. The first and second depths may be the same or different. If the first and second depths are different, at least a portion of the rail will be supported at an angle within the channel.

The pair of support members may be spaced apart using a solid spacer member configured to abut one side wall of the channel between the pair of support members. The solid spacer member may help to prevent light passing between the pair of support members which may be important if the zip-like screen is being used as a blackout blind. The solid spacer member may have at least one recess on one side which in use abuts the side wall of the channel, the at least one recess being configured to encourage localised deformation and countersinking of a screw driven through the solid spacer member from an opposing side, for example when securing the apparatus to a support surface.

The at least one support member may have a substantially "U"-shaped cross section, and comprise a first support part and a second support part which in use engages the first support part, with each support part comprising complementary components of the plurality of profiles. With such an arrangement, the at least one support member may be introduced into the channel one part at a time. The first and second support parts may have male and female interengageable profiles for engaging the second support part to the first support part. The first and second support parts may be identical, with each part having both male and female interengageable profiles.

In accordance with another aspect of the present invention, there is provided a method a installing a screen system, comprising: providing a zip-like screen which includes a blind mounted on a roller, the blind having flexible strips on each lateral side thereof, each of the flexible strips being configured to engage a keyway in a rail; mounting the zip-like screen with its roller in its intended position; providing the apparatus in accordance with a first aspect of the invention; mounting the elongate body of the apparatus to one side of the zip-like screen; selecting one of the profiles of the at least one support member which will maintain the rail at an appropriate depth within the channel to enable one lateral side of the blind to slidingly engage the keyway of the rail when coupled to the at least one support member, and coupling the rail to the selected profile of the at least one support member.

The second aspect of the invention may comprise any of the features described with reference to the first aspect of the invention.

BRIEF DESCRIPTION OF THE DRAWINGS

An embodiment of the invention will now be described with reference to the accompanying drawings in which.

DETAILED DESCRIPTION OF SPECIFIC EMBODIMENTS

Figure 1A:
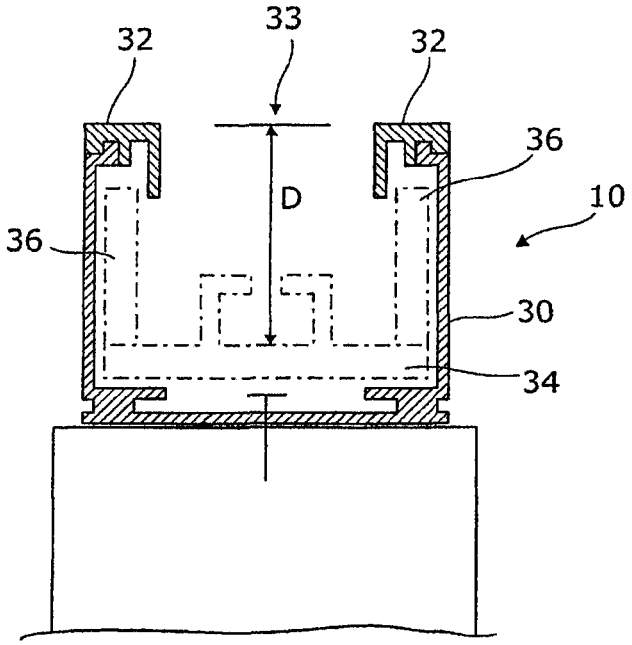
Figure 1A (Prior Art)
FIGS. 1A and 1B showing schematically prior art brackets for mounting a rail for guiding a zip screen.
Figure 1B:
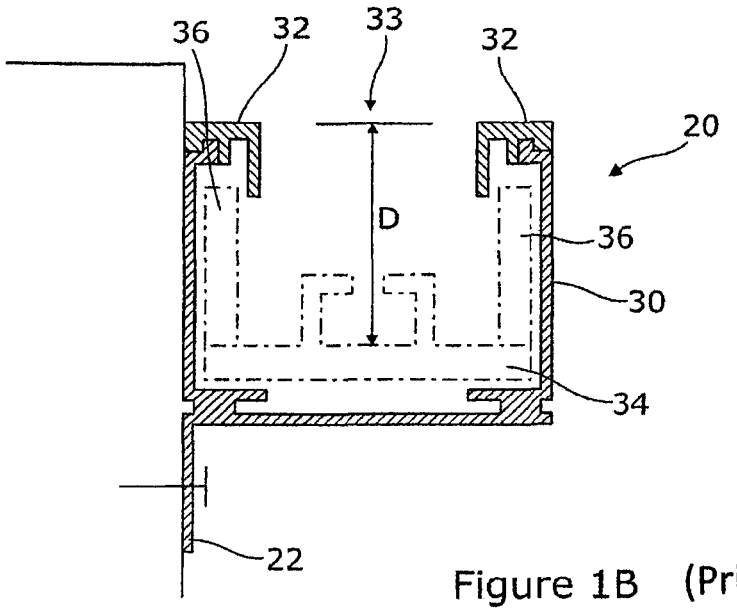
Figure 1B (Prior Art)
Figure 2:
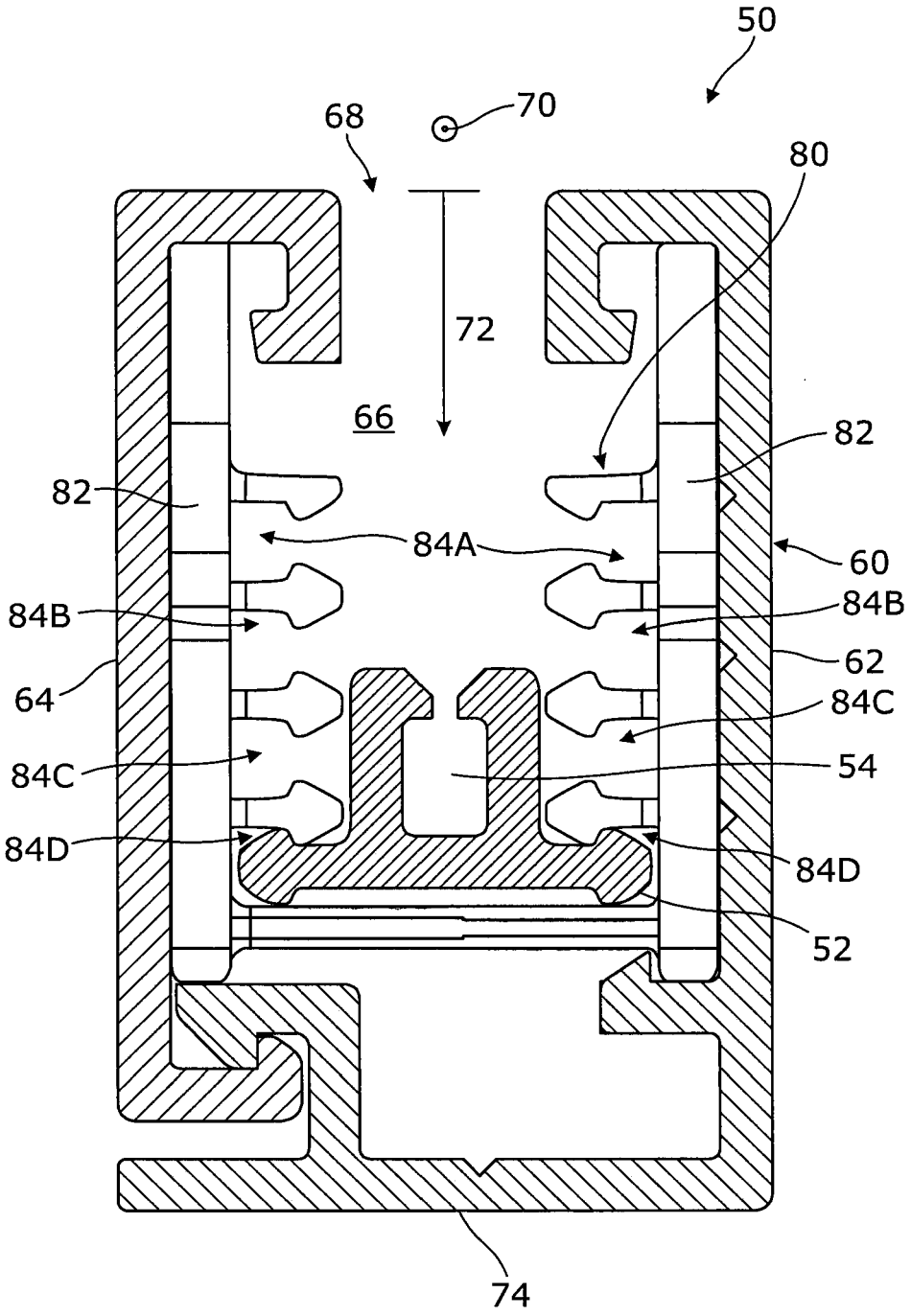
FIG. 2 shows a cross-sectional view of apparatus embodying the present invention.

FIG. 2 illustrates a cross-sectional view of apparatus 50 embodying the present invention which is configured to mount a rail 52 with a keyway 54 for guiding one lateral side of a zip-like screen (not shown). The apparatus 50 comprises an elongate body 60, comprising a first elongate part 62 and a second elongate part 64, having a channel 66 for receiving the rail 52. The channel 66 has an open top 68 extending in a first direction 70 along the elongate body (i.e. perpendicular to the page as shown in FIG. 2), and a depth extending in a second direction 72 perpendicular to the first direction 70, from the open top 68 towards the opposing base 74 of the channel 66. The rail 52 is supported in the channel 66 by a support mechanism 80 comprising at least one support member 82 having a plurality of profiles 84A, 84B, 84C, 84D spaced in the second direction 72 when positioned in the channel 66. Each profile 84A, 84B, 84C, 84D is configured to support the rail 52 at a different depth in the channel 66. As shown in FIG. 2, the support member 82 has four profiles 84A, 84B, 84C, 84D, with the rail 52 being supported by the lowest profile 84D in the deepest position within the channel 66.

Figure 3:
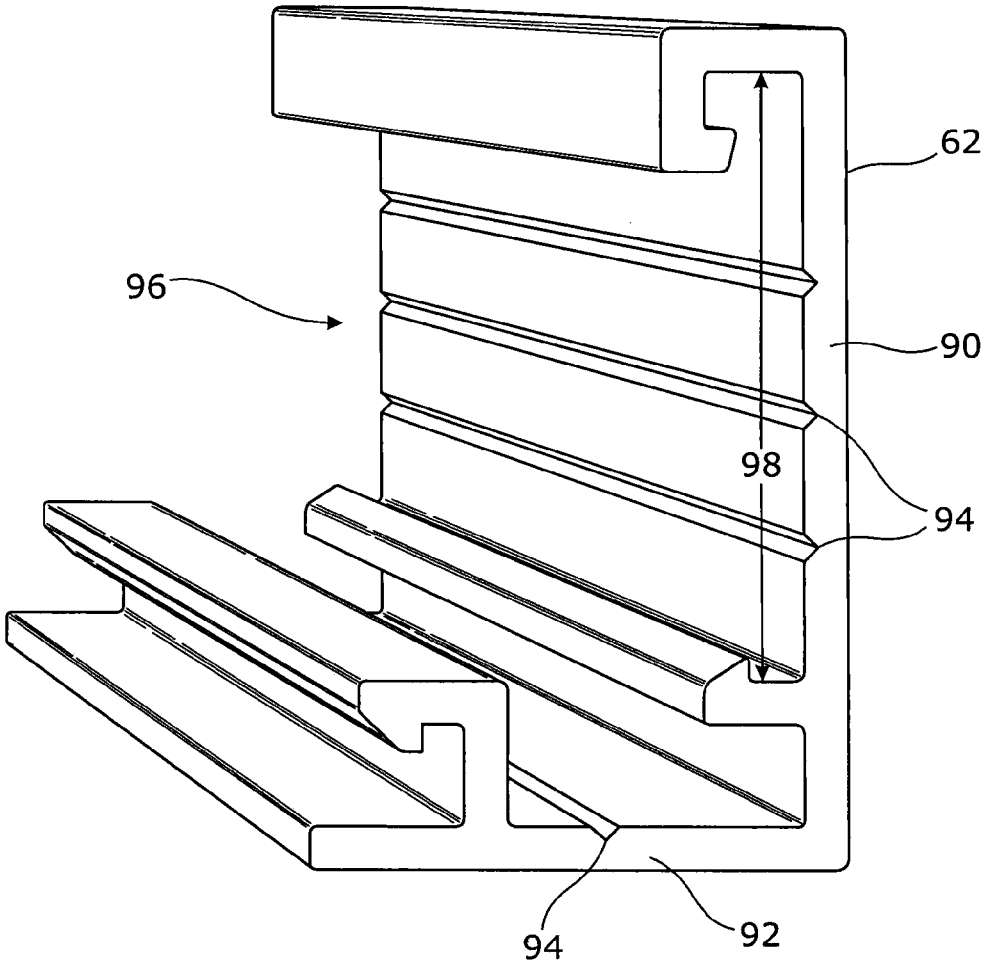
FIG. 3 is a perspective view showing details of a first elongate part of the apparatus shown in FIG. 2.
Figure 4:
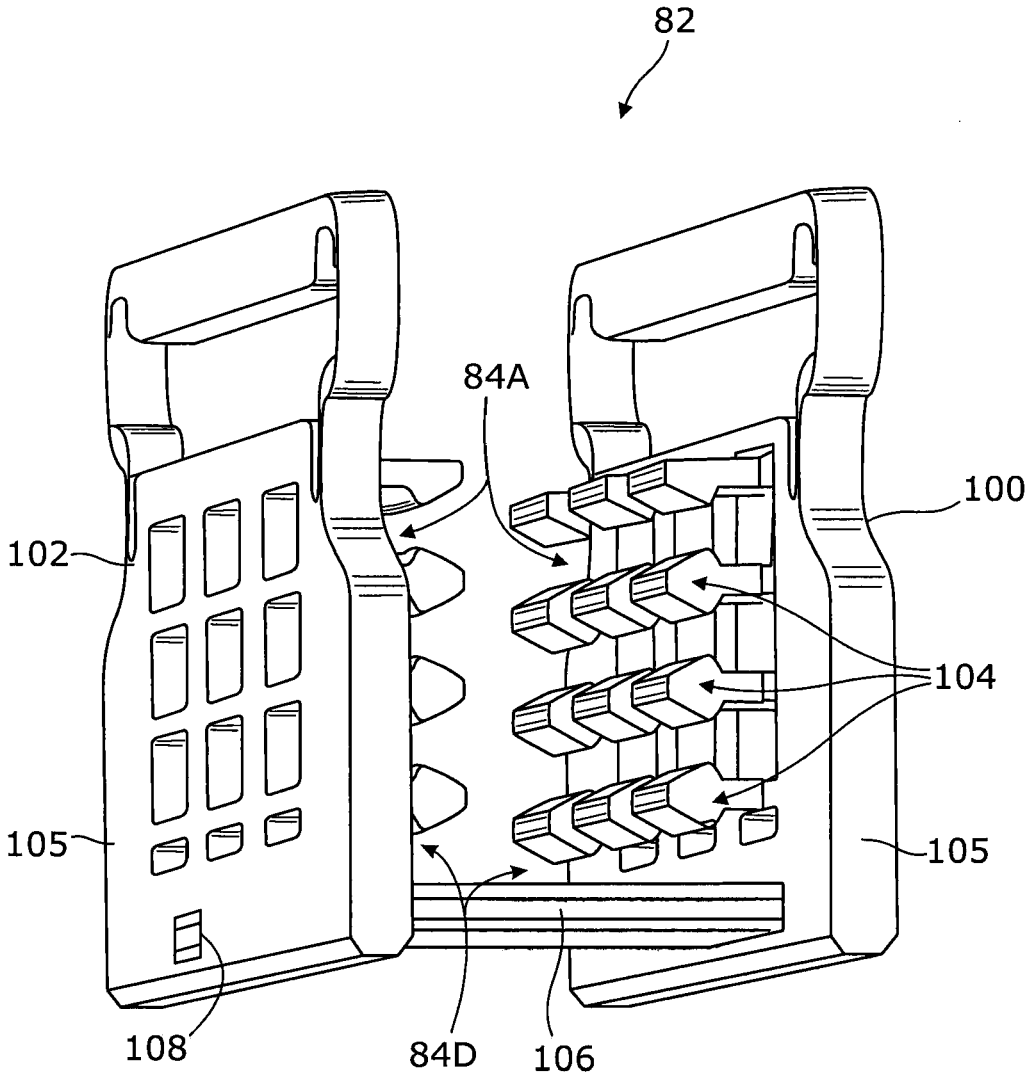
FIG. 4 is a perspective view showing details of a support member of the apparatus shown in FIG. 2.

The first elongate part 62 of the elongate body 60 is illustrated in FIG. 3. The first elongate comprises a first wall 90 and a second wall 92 angled at about 90° to the first wall 90, giving rise to an "L"-shaped cross section. Both the first and second walls 90, 92 include notches 94 for receiving screws when fixing one or other wall 90, 92 to a support surface. The first wall 90 of the first elongate part 62 defines a first side wall 96 of the channel 66. The first side wall 96 of the channel 66 includes a groove 98 for retaining the support mechanism 80 in the channel 66. As shown in FIG. 4, each support member 82 of the support mechanism 82 has a substantially "U"-shaped cross-section in use and comprises a first support part 100 and a second support part 102. The first and second support parts 100, 102 are identical, and thus each comprises a body 105 with complementary components 104 of the plurality of profiles 84A, 84B, 84C, 84D, together with both male and female connectors 106, 108 for releasably interconnecting the first and second support parts 100, 102 together.

Figure 5:
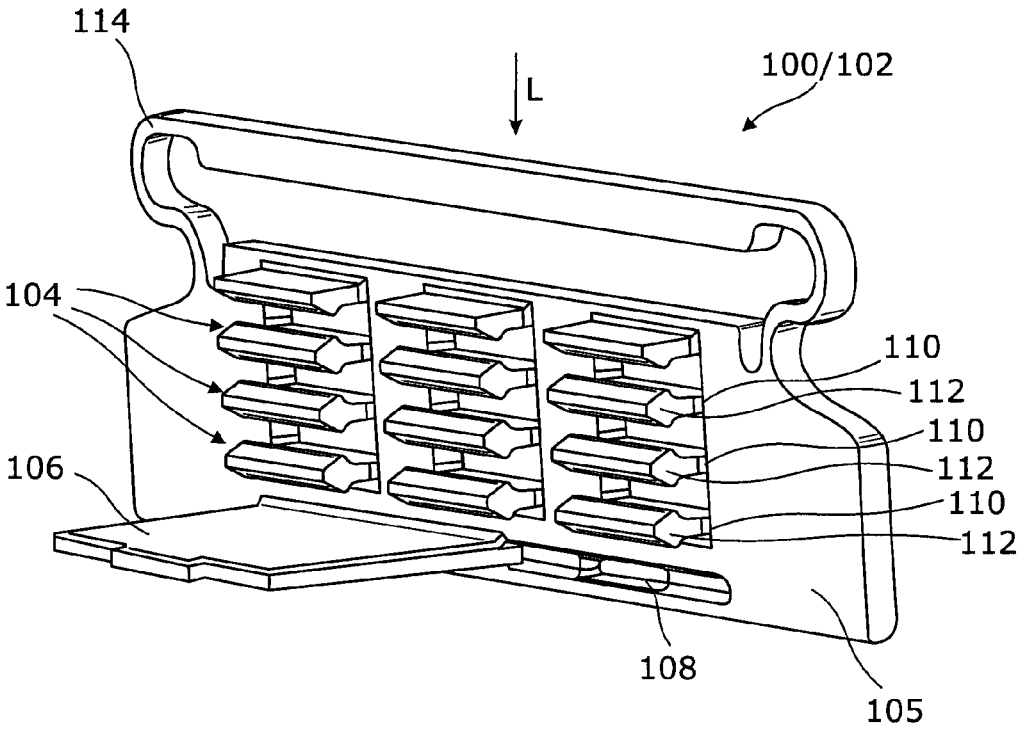
FIG. 5 is a perspective view showing details of the support member shown in FIG. 4.

The structure of the first and second support parts 100, 102 is shown in more detail in FIG. 5. The components 104 of the profiles 84A, 84B, 84C, 84D are in the form of a series of tabs 110 projecting from the body 105. Each tab 110 has an enlarged leading portion 112 to define a constriction in the space between adjacent tabs 110. The body 105 includes a resilient portion provided in the form of spring member 114 which is configured to flex under an applied load L. The body 105 is a sliding fit in the groove 98 of the first elongate part 62.

Figure 6:
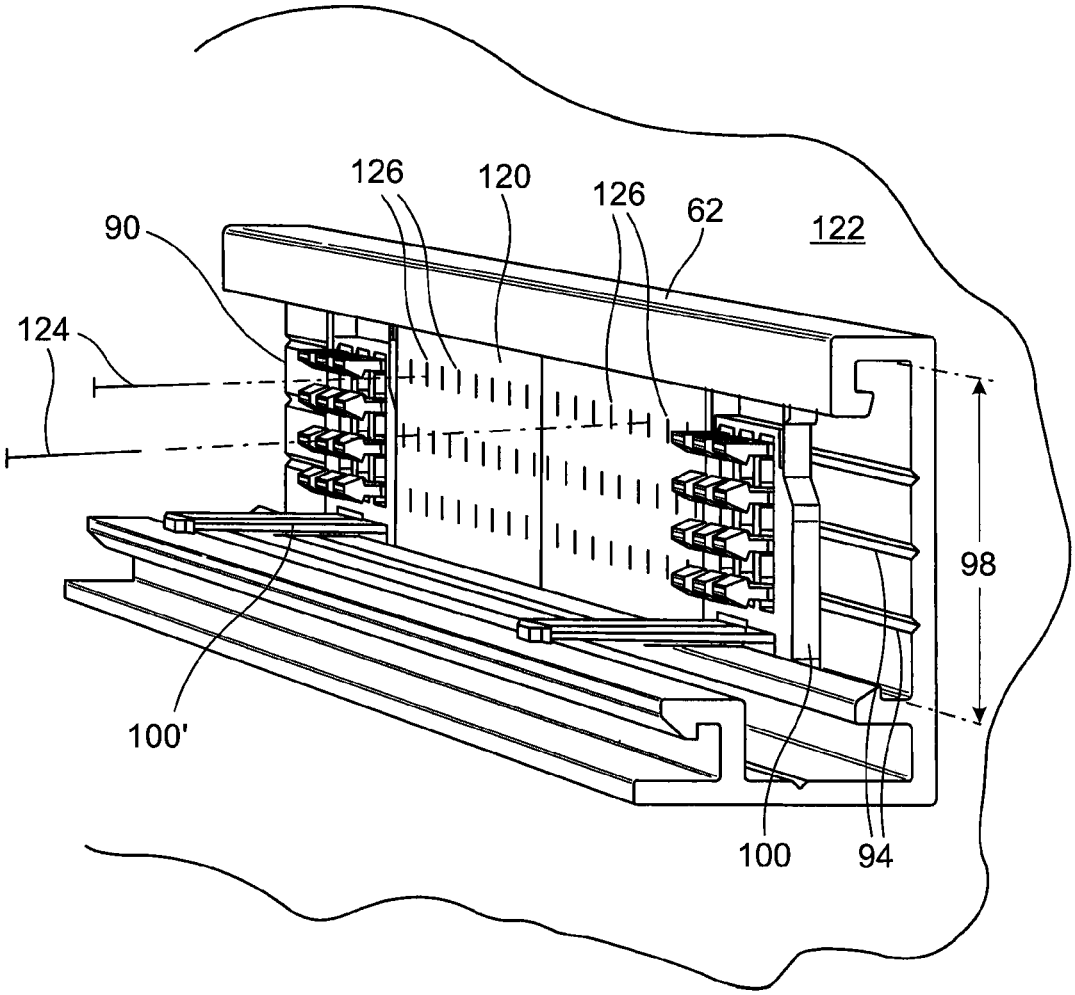
FIG. 6 is a perspective view showing assembly details of the apparatus shown in FIG. 2.
Figure 7:
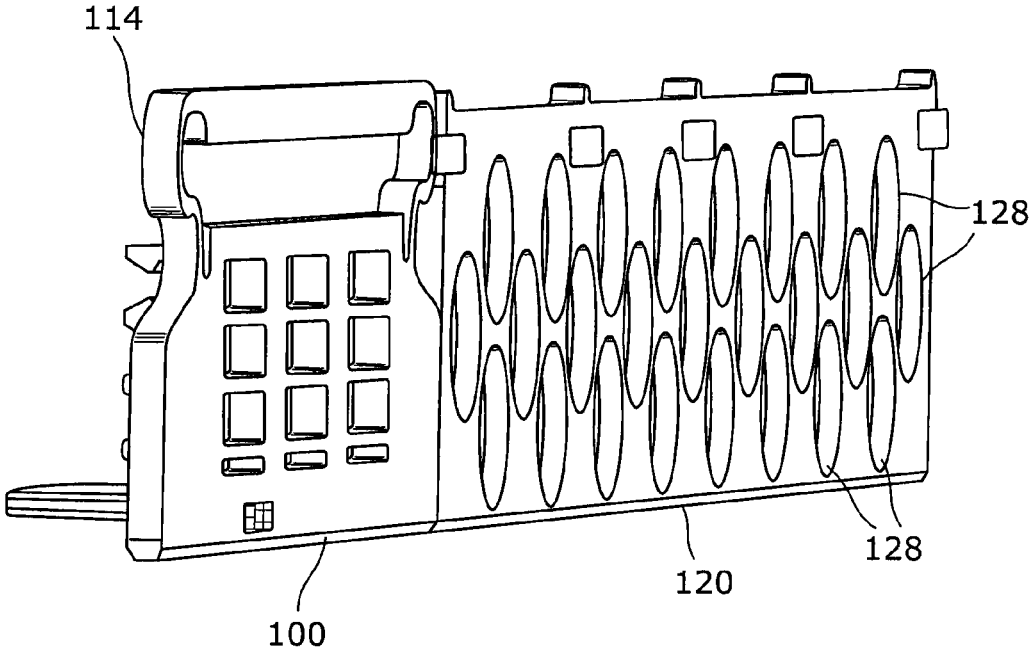
FIG. 7 is a perspective view showing details of components shown in FIG. 6.

As shown in FIG. 6, two of the first support parts 100, 100' are introduced into the groove 98 of the first elongate part 62. The two first support parts 100, 100' are separated by a solid spacer member 120 which is also a sliding fit in the groove 98. The solid spacer member 120 not only maintains a minimum separation between the two first support parts 100, 100' during use, but also helps to block passage of light between the two first support parts 100, 100'. The first elongate part 62 may be fixed to a support surface 122 using screws 124 which pass through the solid spacer member 120. The marks 126 on the visible surface of the solid spacer member 120 register with the notches 94 to help with driving the screws through the wall 90. The marks 126 also register with recesses 128 on the underside of the solid spacer member 120, as shown in FIG. 7. The recesses 128 encourage local deformation of the solid spacer member 120 when driving screws therethrough to allow screw countersinking, without compromising the light blocking role of the solid spacer member 120.

Figure 8:
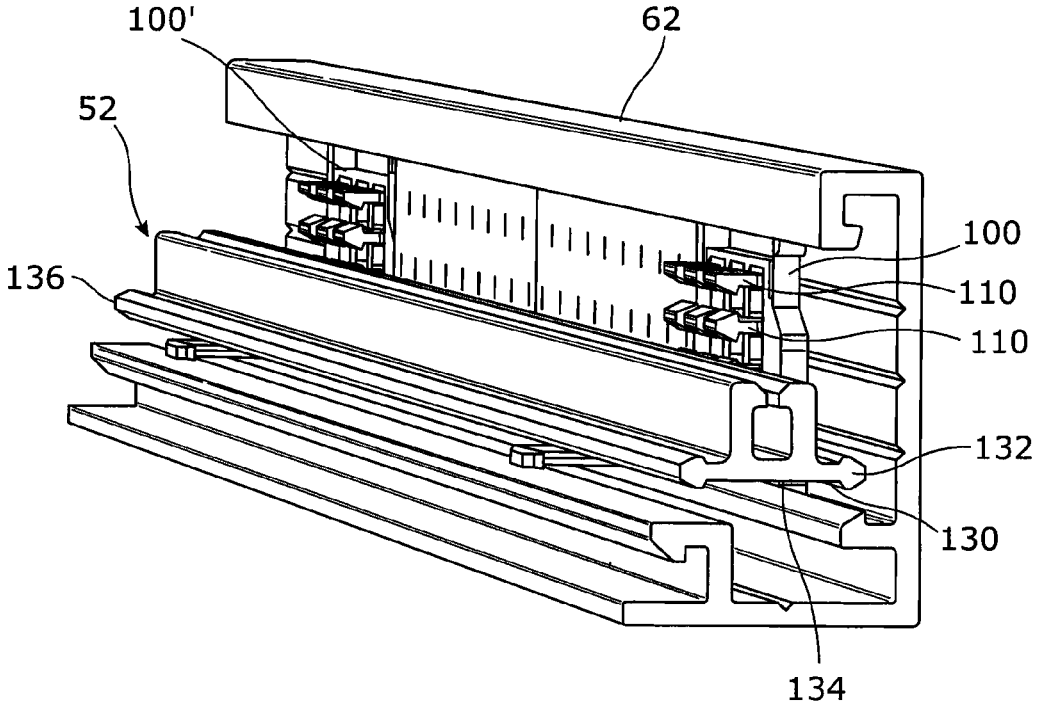
FIG. 8 is a perspective view showing additional assembly details of the apparatus shown in FIG. 2.

The next step in assembling the apparatus 50 involves coupling the rail 52 to selected components 104 of the profiles 84A, 84B, 84C, 84D of the two first support parts 100, 100'. The rail 52 has a lateral flange 130 with an enlarged edge portion 132 which is configured to engage a space between the tabs 110 with a snap-fit action. When unconstrained, the rail 52 is able to flex along its length, meaning that it need not be installed parallel to the first elongate part 62. For example, a first end 134 of the rail 52 may be urged into engagement with the components 104 of the profile 84A towards the top of the first support part 100, whereas a second end 136 of the rail 52 may be urged into engagement with the components 104 of the profile 84C towards the bottom of the first support part 100'. It may be necessary to incline the rail 52 relative to the first elongate part 62 in such a manner in order to ensure the zip-like screen is able to be guided by the rail 52 without creasing or jamming, as will be explained in more detail below. However, for simplicity, FIG. 8 illustrates the rail 52 engaging the components 104 of the profile 84D of both the first support parts 100, 100', meaning that the rail 52 is parallel to the first elongate part 62.

Figure 9:
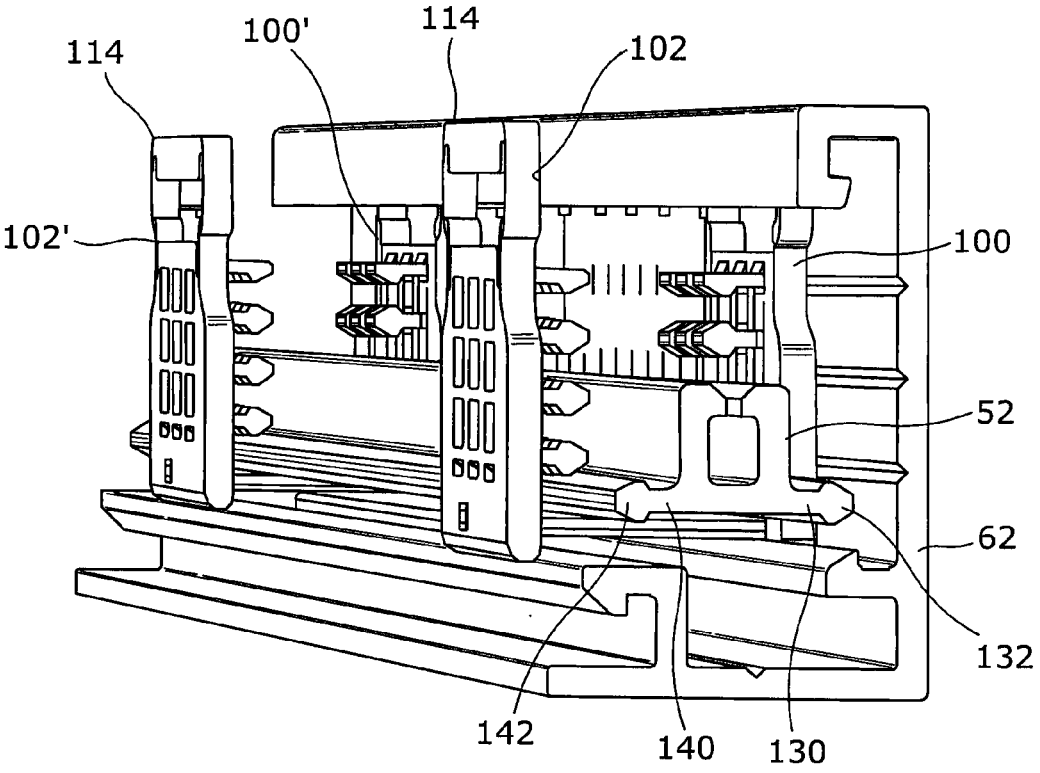
FIG. 9 is a perspective view showing additional assembly details of the apparatus shown in FIG. 2.
Figure 10:
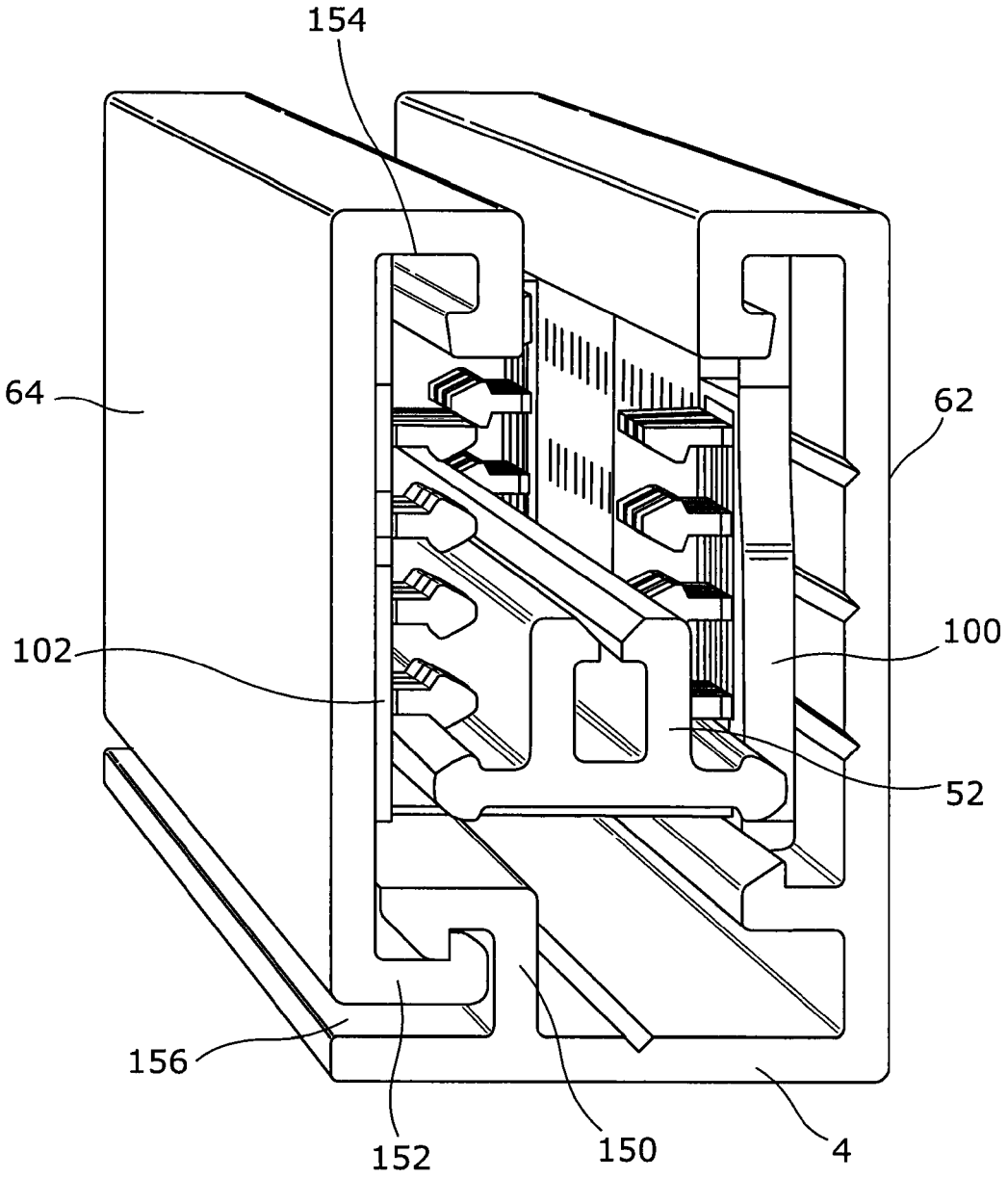
FIG. 10 is a perspective view of the apparatus shown in FIG. 2.

Once the rail is coupled to the first support parts 100, 100', two second support parts 102, 102' are coupled to the rail 52 as shown in FIG. 9. One second support part 102 is registered with the first support part 100, and the other second support part 102' is registered with the first support part 100'. The rail has a second lateral flange 140 with an enlarged edge portion 142 which is configured to engage a space between tabs 110 with a snap-fit action. As the two second parts 102, 102' are clipped on to the rail 52, corresponding pairs of male and female connectors 106, 108 interconnect.

The assembly of the apparatus 50 is completed by coupling the second elongate part 64 to the first elongate part 62 using interengageable profiles 150, 152. The spring member 114 of each second support part 102, 102' is introduced into a groove 154 extending along an upper portion of the second elongate part 64. Pressure is applied to the second elongate part 64 to compress the spring members 114 to enable hook-like profile 152 extending along a lower portion of the second elongate part 64 to engage a corresponding hook-like profile 150 protruding from the second wall 94 of the first elongate part 62. Once the hook-like profiles 150, 152 are interengaged, a filler strip may be introduced into gap 156 to resist disengagement of the first and second elongate parts 62, 64.

Figure 11:
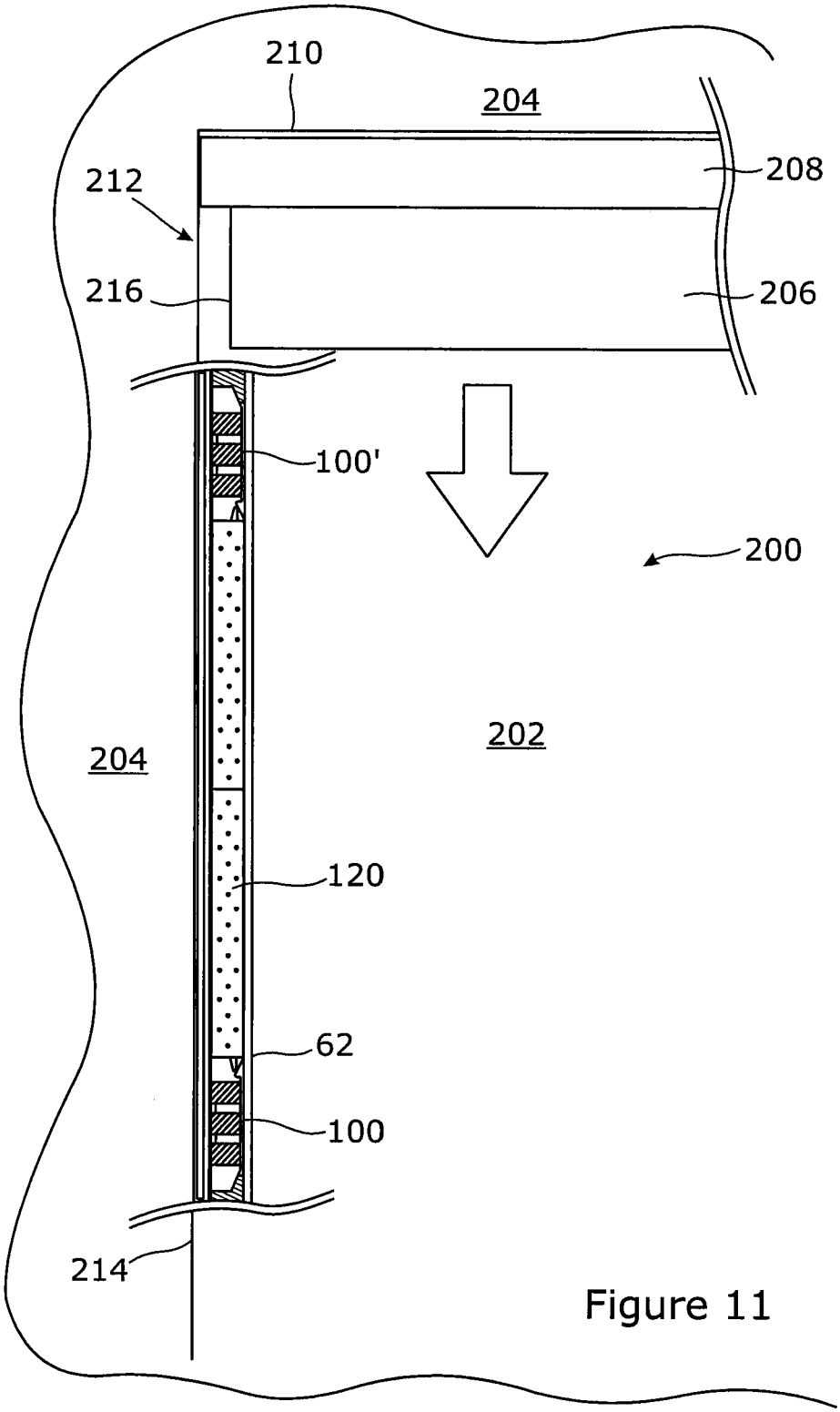
FIG. 11 illustrates installation of a zip-like screen system using the apparatus of FIG. 2.

A method of mounting the apparatus 50 to the inner periphery of a window reveal will now be described with reference to FIG. 11. A screen system 200 is to be used to screen a window 202 in a wall 204. The screen system 200 includes a zip-like screen 206 mounted on a roller in a housing 208. The housing is fixed horizontally to the underside 210 of the window reveal 212, and the first elongate part 62 (complete with the first support parts 100, 100' and spacer member 120) is fixed substantially vertically to one inner side 214 of the window reveal 212. For simplicity, FIG. 11 only shows a section of the first elongate part 62; in practice, it would be longer and include many pairs of the first support parts 100, 100' and spacer member 120. Using a lateral edge 216 of the zip-like screen 206 as a guide, the rail 52 is then coupled to the first support parts 100, 100' in exactly the correct position to ensure the zip-like screen 206 is able to be guided by the rail 52 without creasing or jamming. If the inner side 214 of the window reveal 212 is truly vertical, the first elongate part 62 will also be vertical and the rail 52 will be mounted vertically by engaging components 104 of the same profile (e.g. profile 84C) of each first support part 100, 100'. However, if the inner side 214 of the window reveal 212 is slightly inclined to the vertical, the first elongate part 62 may also be slightly inclined to the vertical. Nevertheless, the rail 52 may still be mounted vertically in the first elongate part 62 by coupling it to components 104 of different profiles (e.g. profile 84A and profile 84C) of the first support parts 100, 100'.

Once the rail 52 is aligned within the first elongate part 62 to register with the lateral edge 216 of the zip-like screen 206 as it is deployed, the assembly of the apparatus may be completed as described with reference to FIGS. 2-10. A corresponding assembly 50 is fixed to an opposing side of the window reveal 212. The zip-like screen is then ready to be guided as it is deployed/retracted. The spring members 114 of the first and second support parts 100, 100', 102, 102' are able to flex within the elongate body 60, allowing small lateral movements of the rail 52 relative to the first and second elongate parts 62, 64 to help keep the zip-like screen 206 taut without causing it to jam when deployed/retracted.

The invention claimed is:

1. An apparatus for mounting a rail for guiding one lateral side of a screen which includes a blind mounted on a roller, the blind having along said one lateral side a flexible strip configured to engage a keyway in the rail, comprising:

an elongate body having a channel for receiving the rail, the channel having an open top extending in a first direction along the elongate body and a depth extending in a second direction from the open top towards an opposing base of the channel; and a support mechanism, configured to be positioned in the channel, for supporting the rail when received in the channel;

wherein the support mechanism comprises two support members each having a plurality of profiles spaced in the second direction when positioned in the channel, with each profile of each support member being configured to support the rail at a different depth in the channel, the two support members being spaced apart in the first direction; and wherein at least one of said two support members comprises a resilient portion for resiliently supporting the rail when received in the channel, the resilient portion being configured to allow movement of the plurality of profiles of said at least one of said two support members towards the open top of the channel in response to an applied load on the rail tending to pull the rail towards the open top of the channel.

2. The apparatus according to claim 1, wherein the resilient portion comprises a spring member.

3. The apparatus according to claim 1, wherein at least one side wall of the channel is shaped to retain the at least one of said two support members within the channel in use.

4. The apparatus according to claim 3, in which the at least one side wall of the channel includes a groove extending therealong for engaging one side of the at least one of said two support members.

5. The apparatus according to claim 1, wherein the two support members are spaced apart using a solid spacer member configured to abut one side wall of the channel between the two support members.

6. The apparatus according to claim 5, wherein the solid spacer member has at least one recess on one side which in use abuts the side wall of the channel, with each recess being configured to facilitate, through localised deformation of the solid spacer member, countersinking of a screw driven through the solid spacer member from an opposing side of the solid spacer member.

7. The apparatus according to claim 1, wherein the elongate body comprises a first elongate part and a second elongate part which in use is coupled to the first elongate part, with the first elongate part defining a first side wall of the channel and the second elongate part defining a second side wall of the channel.

8. The apparatus according to claim 7, wherein the first and second elongate parts have profiles engageable with one another for releasably coupling the second elongate part to the first elongate part.

9. The apparatus according to claim 7, wherein the first elongate part comprises a first wall inclined relative to a second wall, with each of the first and second walls being configured to receive a fixture therethrough for securing the first elongate part to a support surface.

10. The apparatus according to claim 1, wherein at least one of said two support members comprises a first support part and a second support part which in use engages the first support part, with each support part comprising complementary components of the plurality of profiles.

11. The apparatus according to claim 10, wherein the first and second support parts have male and female profiles engageable with one another for engaging the second support part to the first support part.

12. The apparatus according to claim 10, wherein the first and second support parts are identical.

13. A method of installing a screen system, comprising:

providing a screen which includes a blind mounted on a roller, the blind having flexible strips on each lateral side thereof, each of the flexible strips being configured to engage a keyway in a rail;

mounting the screen with its roller in its intended position;

providing an apparatus comprising: an elongate body having a channel for receiving the rail, the channel having an open top extending in a first direction along the elongate body and a depth extending in a second direction from the open top towards an opposing base of the channel;

and a support mechanism, configured to be positioned in the channel, for supporting the rail when received in the channel, the support mechanism comprising two support members, each having a plurality of profiles spaced in the second direction when positioned in the channel, with each profile of each support member being configured to support the rail at a different depth in the channel, the two support members being spaced apart in the first direction, and wherein at least one support member comprises a resilient portion;

mounting the elongate body of the apparatus to one side of the screen;

selecting one of the profiles of each of the two support members which will maintain the rail at an appropriate depth within the channel to enable one lateral side of the blind to slidingly engage the keyway of the rail when coupled to at least one of the two support members, with the rail being resiliently supported in the channel by the resilient portion of said at least one support member to allow movement of the plurality of profiles of said at least one support member towards the open top of the channel in response to an applied load on the rail tending to pull the rail towards the open top of the channel; and coupling the rail to the selected profile of each of the two support members.

* * * * *